US005132499A

United States Patent [19]

Valenzona et al.

[11] Patent Number: 5,132,499

[45] Date of Patent: Jul. 21, 1992

[54] PRE-LOADED SWITCHING APPARATUS AND METHOD OF OPERATION

[75] Inventors: Joseph F. Valenzona, El Toro, Calif.; Robert J. Smith, Farminton, Mich.

[73] Assignee: Judco Manufacturing, Inc., Harbor City, Calif.

[21] Appl. No.: 453,007

[22] Filed: Dec. 18, 1989

Related U.S. Application Data

[63] Continuation-in-part of Ser. No. 352,738, May 16, 1989, abandoned.

[51] Int. Cl.[5] ..... H01H 13/58; H01H 19/62

[52] U.S. Cl. ..... 200/526; 200/527; 200/529

[58] Field of Search ..... 200/527, 526, 529, 276.1

[56] References Cited

U.S. PATENT DOCUMENTS 977,446 12/1910 Gervin ..... 200/527

3,204,067 8/1965 Brown ..... 200/527

4,209,682 6/1980 Rood ..... 200/276.1 X 4,317,015 2/1982 Buttner et al. ..... 200/526

FOREIGN PATENT DOCUMENTS 1235268 6/1971 United Kingdom ..... 200/527

*Primary Examiner*—Henry J. Recla

*Assistant Examiner*—David J. Walczak

*Attorney, Agent, or Firm*—G. Norden Hanover

[57] ABSTRACT

A miniature ratchet type push button activated electrical switch having a mainspring and an auxiliary spring wherein spring rates, spring lengths and spring orientations are selected such that a substantial depression of the push button is required before electrical continuity is broken in a closed circuit. This configuration additionally serves to reduce the amount of audible noise generated by the switch during the ratcheting operation.

4 Claims, 4 Drawing Sheets

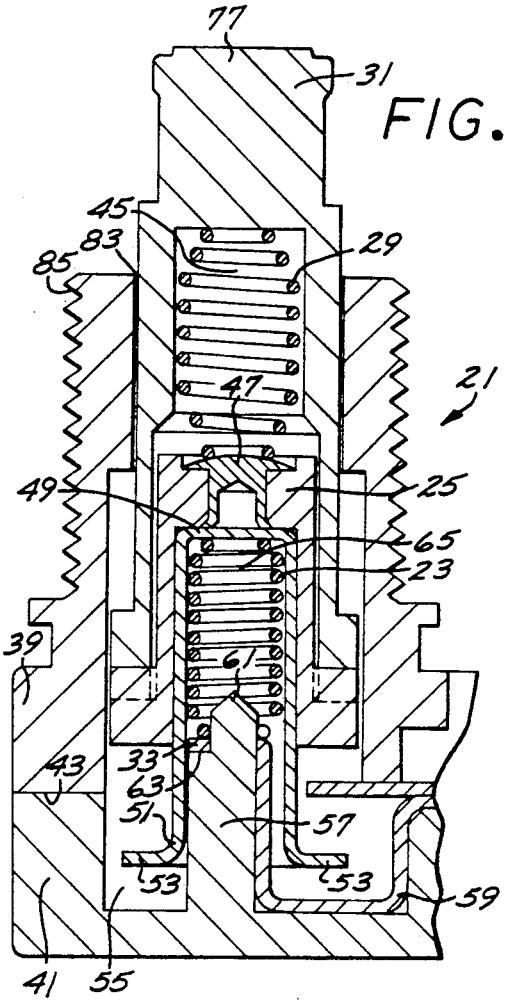
FIG.4
FIG.5
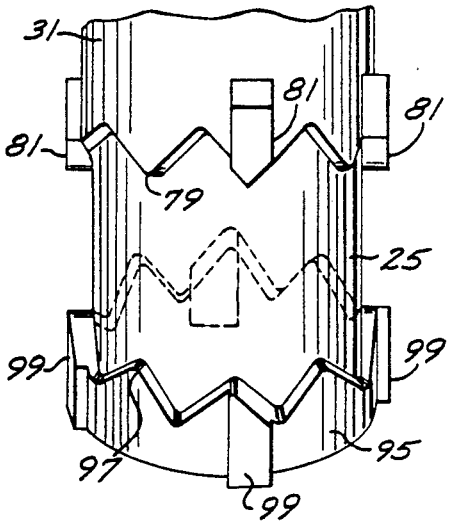
FIG.6
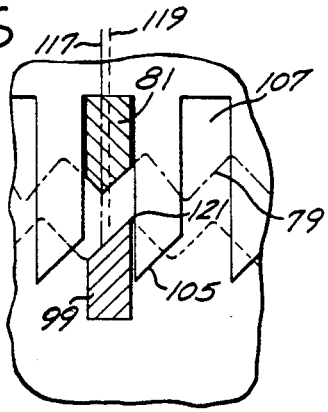
FIG.7
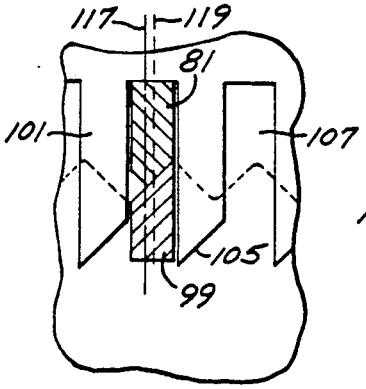
FIG.8
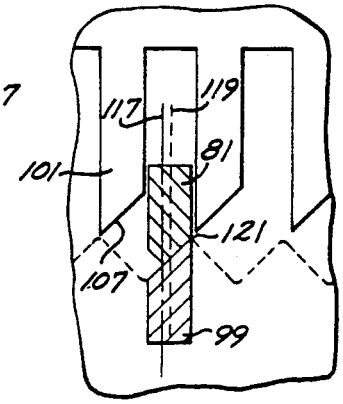
FIG.9
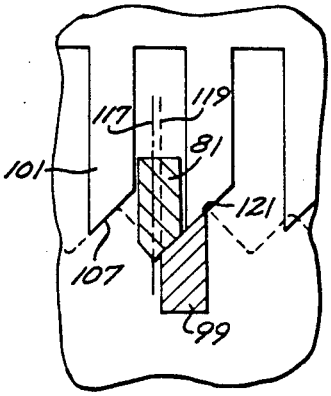

PRE-LOADED SWITCHING APPARATUS AND METHOD OF OPERATION

CROSS-REFERENCE TO RELATED APPLICATION

The present application is a continuation-in-part of U.S. patent application Ser. No. 07/352,738, filed May 16, 1989, now abandoned.

BACKGROUND OF THE INVENTION

1. Field of the Invention

This invention relates to miniature switches for use in electrical circuits, and more particularly pertains to miniature push button electrical switches employing a ratchet mechanism.

2. Description of the Related Art

A number of different types of push button actuated switch mechanisms have been developed to fulfill the function of making and breaking electrical contact upon depression of a button. Of particular interest, for the purposes of the present invention, are those mechanisms that employ a ratchet mechanism that serves to convert depression of a button to incremented rotation of a first electrical contact within the switch. The switch is configured such that this incremented rotation of the first electrical contact causes it to alternately engage and disengage a stationary second electrical contact within the switch. An electrical connection is thereby alternately made or broken upon each depression of the button.

A disadvantage or shortcoming typically inherent in such ratchet mechanism type push button switches is the fact that electrical continuity between the two contacts is broken immediately upon initial depression of the push button, or more correctly, upon initial displacement of the activating plunger. Conversely, should the movement of the plunger be impeded so as to prevent complete extension thereof, the contacts can not make contact with one another, and consequently, the switch effectively fails to function. The free extension of the plunger may be impeded by, for example, physical contact with its surroundings due to its orientation in a particular installation or due to binding of the entire mechanism caused by distortion of the as a result of too tight a fit within a mounting surface.

This described shortcoming poses a particularly bothersome nuisance on a high-speed assembly line of automobiles where the time required to carefully and properly install each of perhaps a multitude of such switches may simply not be available. A misaligned installation or perhaps the overtightening of a fastner can result in an obstruction of the plunger's movements, and as was alluded to above, will prevent the switch from closing a circuit. The entire circuit will therefore appear not to function requiring a diagnosis of the problem to be undertaken and after isolation of the fault, the switch would ultimately have to be replaced or appropriate adjustments in the reinstallation made. Hurried assembly, apathetic workmanship, or tolerance stack-up can contribute to the misinstallation of such switches, subsequently requiring these extra remedial measures. It has long been recognized that a ratchet mechanism push button switch design is needed that is not sensitive to minor interference with movement of the plunger in order to increase the efficiency of high volume assembly lines and provide trouble-free service.

SUMMARY OF THE INVENTION

Briefly, and in general terms, the present invention provides a new and improved miniaturized push button ratchet switch construction and method which maintains continuity between two opposed electrical contacts until the push button has been depressed a considerable distance. This feature enables the switch to function properly despite minor interference with the movement of the plunger. Additionally, a reduction in audible noise is achieved during the switching operation of the switch. The ratchet switch construction of the present invention utilizes many of the standard parts of existing ratchet switches and retains the capability of switching multiple circuits. This is accomplished by modifying the design of a known ratchet switch such that the force exerted by an auxiliary spring bears a preselected relation to the force exerted by the switch's mainspring.

In accordance with a preferred embodiment of the invention, a mainspring serves to both hold two electrical contacts in intimate contact with one another as well as power the ratcheting motion of the switch while the auxiliary spring serves merely to extend the plunger and dampen the motion of the ratchet mechanism during the ratcheting operation to reduce the amount of audible noise produced. The spring rates, spring lengths and orientations of these two springs are selected so that the mainspring is subject to a substantial amount of preload whereby initial depression of the plunger and hence compression of the auxiliary spring does not alter the length of the mainspring. In order to achieve adequate force to hold the electrical contacts in intimate contact with one another, yet not generate a superflurous amount of force upon compression to thereby reduce the amount of noise generated upon ratcheting, a relatively long mainspring with a relatively low spring rate is subjected to a substantial amount of preload. An auxiliary spring, generating substantially less force at all times ensures that net force exerted by the springs on the ratchet mechanism does not substantially change during the initial stages of depression of the plunger.

Further, in accordance with the improved method of the present invention, the ratchet switch is connectable within an electrical circuit in either a single-pole, single-throw or a single-pole, double-throw configuration so that the switch either simply turns a single circuit on and off, or in the alternative, alternately connects two different electrical circuits. Upon depression of the plunger, the ratchet mechanism is actuated resulting in the rotation of the ratchet mechanism in conjunction with a contact cup which changes the position of the contact terminals resulting in modifications to the electrical interconnections. The auxiliary spring is oriented to exert a force that opposes a minor portion of the force exerted by the mainspring on the ratchet mechanism and thereby serves to extend the plunger to prevent rattling of the mechanism and present a tidier physical appearance of the installed switch and further serves to dampen the motion of the ratchet mechanism during actuation.

The new and improved ratchet switch and method of operation of the present invention utilizes the standard parts of existing ratchet switches, is capable of switching multiple circuits, and prevents misoperation of the switch due to minor interference with the movement of the plunger, and produces less audible noise during ratcheting.

These and other features and advantages of the invention will become apparent from the following more detailed description, when taken in conjunction with the accompanying drawings, which illustrate, by way of example, the features of the invention.

BRIEF DESCRIPTION OF THE DRAWINGS

FIG. 4 is an enlarged cross-sectional view of the miniature ratchet switch of FIG. 1 in its completely depressed state;

FIG. 5 is a further enlarged perspective view of the ratcheting mechanism in accordance with the invention of FIG. 1;

FIGS. 6–12 are fragmentary cross-sectional views of the ratchet mechanism throughout a switching sequence;

DETAILED DESCRIPTION OF THE PREFERRED EMBODIMENT

Figure 1:
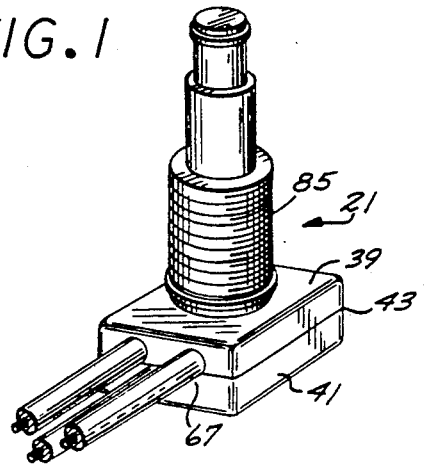
FIG. 1 is a perspective view of a miniature ratchet switch employing the novel features in accordance with the present invention.

As shown in the drawings, which are included for purposes of illustration, but not by way of limitation, the invention is embodied in a miniature ratchet switch 21 of the type having a mainspring 23 for operating a ratchet mechanism to rotate a contact cup 27 which alternately interconnects common input terminal 33 with either terminal 35 or 37 and further having an auxiliary spring 39 fitted within the ratchet switch which exerts a relatively small force to extend the plunger 31.

Figure 3:
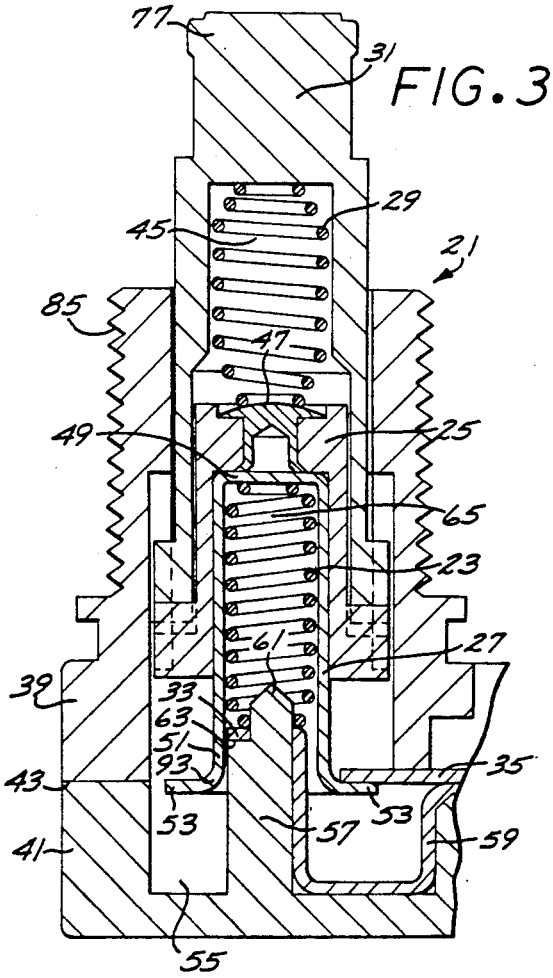
FIG. 3 is an enlarged cross-sectional view of the miniature ratchet switch of FIG. 1 in a partially depressed state.
Figure 10:
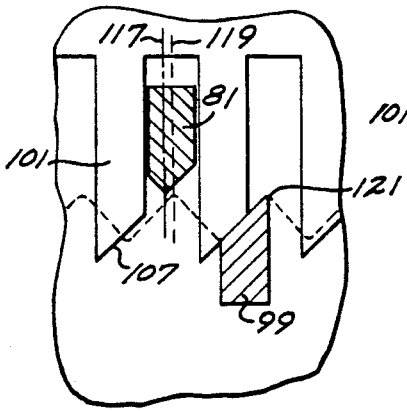
Figure 11:
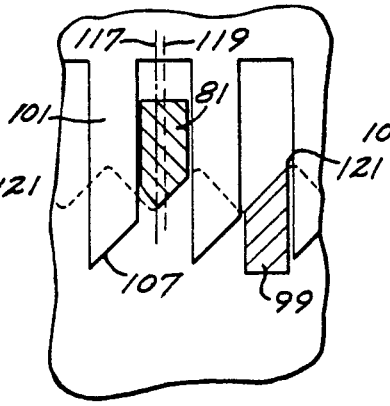
Figure 12:
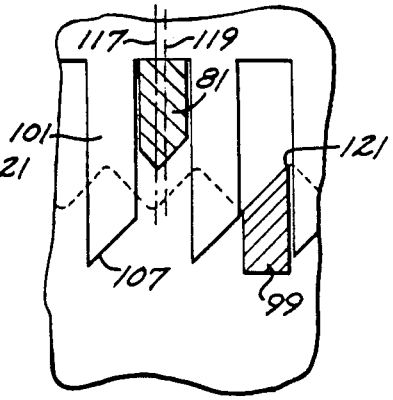
Figure 13:
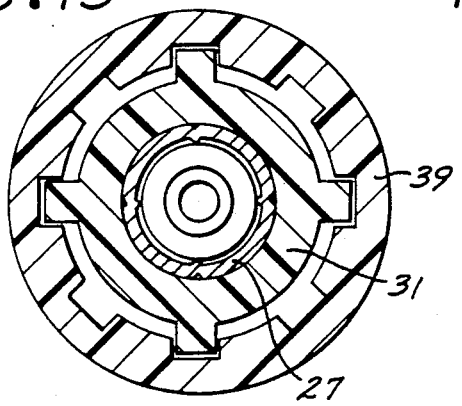
FIGS. 13 and 14 are cross-sectional views of the ratchet mechanism before and after a switching operation.
Figure 14:
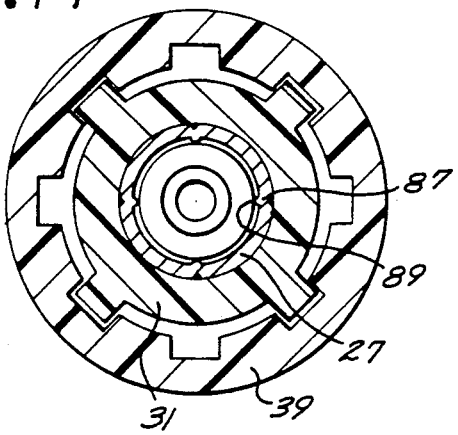

There is a need in the electrical industry for a miniaturized push button actuated ratchet switch mechanism wherein continuity between electrical contacts is maintained until the push button reaches a substantially depressed position which the switch of the design of the present invention fulfills. In accordance with the present invention, an auxiliary spring 29 is fitted within the plunger 31 and is thereby oriented to oppose the force generated by the mainspring 23 on the ratchet mechanism. The spring rates, and spring lengths are selected such that the mainspring does not begin to compress until the plunger 31 contacts the ratchet sleeve 25 as illustrated in FIG. 3, and such that only the minimum amount of net force necessary for ratcheting is exerted on the ratchet mechanism during actuation.

The ratchet switch 21 is comprised of two major components, including a body portion 39 and a cover portion 41 as is shown in FIGS. 1–4. The body portion and the cover portion are physically joined at their interface 43. The upper section of the body portion 39 houses a push button plunger 31 and the ratchet mechanism which includes ratchet sleeve 25. The plunger 31 incorporates a hollow 45 which houses the auxiliary spring 29 which is employed to extend the plunger 31 when released and dampen the motion of the ratchet mechanism during actuation.

Mounted in the top end of the ratchet sleeve 25 is a hard steel surface 47, as, for example, a rivet head, which is employed as a seat or thrust bearing for the auxiliary spring 29. The contact cup 27 is metallic and is an integral part of the electrical conducting system of the switch 21. The contact cup generally has the form of a right circular cylinder. A first end 49 is formed with a curved surface which abuts the bottom of the hard steel surface or rivet 47. A second end 51 of the contact cup 27 is fully open and includes a plurality of radially extending extension ears 53 each located in quadrature to one another. The cover portion 41 includes centrally located well 55 to accommodate the electrical connections. A center post 57 rises from the well 55 of the cover portion 41. The center post is generally circular and accommodates an electrical conductor 59 mounted along the vertical side of the center post 57.

The circumference of the top of the center post 57 narrows forming a cone head 61 for penetrating a common input terminal 33 which has the form of a ring. The ring is seated on a ledge 63 formed at the interface between the center post 57 and the cone head 61 with the remainder of the common input terminal 33 being fashioned to be positioned along the vertical portion of the center post 57 and along the bottom of the centrally located well 55 of the cover portion 41. The mainspring 23 mounted within a hollow cavity 65 of the contact cup 27 is in a state of compression between the first end 49 of the contact cup and the ring portion of the common input terminal 33 positioned on the cone head 61 of the center post 57.

An electrical conductor input section 67 is located generally at the interface 43 as shown in FIG. 1. The conductor input section 67 provides three openings 69 for circuiting electrical conductors into the ratchet switch 21. The center opening accommodates a common input conductor 59 which is in electrical communication with the common input terminal 33.

The first input electrical conductor 71 is in electrical communication with a first terminal 35 while the second input electrical conductor 73 is in electrical communication with a second terminal 37. The first and second input terminals 35 and 37 alternately make electrical contact with one of the plurality of extension ears 53. The end of the common input conductor 59 external to the ratchet switch 21 is connected to an electrical source (not shown) while the ends of the first input electrical conductor 71 and the second input electrical conductor 73, which are external to the ratchet switch, are each respectively connected to separate electrical loads (not shown).

The plunger 31 as shown in FIG. 5 is a cylindrical structure surrounding the top portion of the ratchet sleeve 25. Further, the ratchet sleeve 25 is shown as a cylindrical structure surrounding the contact cup 27 which is hollow and houses the mainspring 23 which is a compression-type helical spring. The plunger 31 includes a cylindrical hollow sleeve having a closed surface 77 on one end and a bottom circumference on an opposite end which includes a plurality of downwardly extending serrated teeth 79 and a plurality of radially extending protuberances 81. A single downwardly extending serrated tooth 79 is formed between each adjacent set of protuberances 81.

The plunger 31 is spring loaded by the action of the auxiliary spring 29 and the mainspring 23 and projects from the top of a vertically extending port 83 formed in the body portion 39. The vertically extending port 83 includes a threaded exterior surface 85 utilized in the structural mounting of the entire ratchet switch 21 to an appropriate surface (not shown) such as a control panel.

In the preferred embodiment illustrated, the body portion 39 and the threaded port section 85 are of integrally molded unibody construction formed of insulating plastic. The lever portion 39 is similarly made of insulating plastic.

Figure 2:
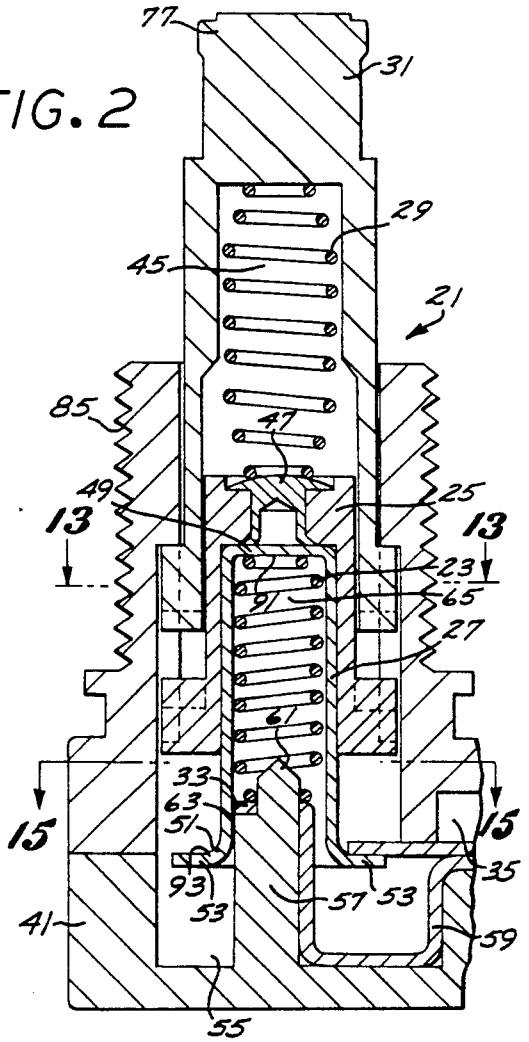
FIG. 2 is an enlarged cross-sectional view of the miniature ratchet switch of FIG. 1 in its completely relaxed state.

The ratchet sleeve 25 has the form of a cylinder having a hollow interior for sliding over the contact cup 27 as shown in FIGS. 2–4. Affixed to the top end of the sleeve is the hard steel surface 47 employed for seating the auxiliary spring 29. The interior of the sleeve 25 includes a plurality of vertical ribs 87 which are orthogonal to he inner wall of the ratchet sleeve 25 and arranged in a quadrature spaced relationship with one another. The cylindrical sleeve 25 slides over the contact cup 27 with the plurality of vertical ribs 87 being received by and sliding through a plurality of congruent vertical grooves 89 formed in the contact cup 27. The cylindrical sleeve 25 when mounted over the top of the contact cup 27 rests within the vertical grooves 89 at their bottom limit so that when activation of the ratchet mechanism causes the ratchet sleeve 25 to rotate, the contact cup 27 is carried along in the direction of rotation with the ratchet mechanism.

The contact cup 27 is metallic and is an integral part of the electrical conducting system as it serves to bridge the various electrical terminals of the switch 21. The contact cup has the general form of a right circular cylinder The first end 91 has a substantially closed surface which abuts the bottom of the hard steel surface or rivet 47. The second end 93 of the contact cup 25 is fully open and includes the plurality of extension ears 53 distributed in a quadrature space relationship to one another. The extension ears act as contacts for connecting to and disconnecting the switch 21 from electrical circuits through the first input terminal 35 and the second input terminal 37.

The ratchet sleeve 25 further includes a ledge 95 formed about its outer circumference having a plurality of upwardly extending serrated teeth 97 and a plurality of protuberances 99 radially extending from the ledge 95 defining four quadrants. A single upwardly extending serrated tooth is formed between each of the ratchet protuberances 99 which are equally distributed about the circumference of the ratchet sleeve 25. Elements associated with the ratchet mechanism which include the ratchet sleeve 98, the contact cup 27 and the plunger 31 are illustrated in detail in FIGS. 2–16.

Insertion of the cylindrical sleeve 25 of the ratchet mechanism into the hollow 45 of the plunger 31 without inclusion of the auxiliary spring 29 would allow the plunger 31 to freely move within the body portion 41 between positions contacting the ratchet sleeve 25 (FIG. 3) and the top section of the port 83 (FIG. 2). However, the construction of the ratchet switch 21 is distinguishable from similar constructions of the past in that the auxiliary spring 29 causes the plunger 31 to be suspended substantially above the ratchet sleeve 25 so that the upwardly extending serrated teeth 97 of the ratchet sleeve 25 do not contact the downwardly extending serrated teeth 79 of the plunger 31 while no force is being applied to the closed surface 77 of the plunger 31. In the uncompressed position, the auxiliary spring 29 in conjunction with the mainspring 23 causes the plunger 31 to extend well above the top of the vertically extending port 83 of the body portion 39 as is illustrated in FIG. 2.

The vertically extending port 83 of the body portion 39 includes a plurality of vertical splines 101 molded into the interior wall 103 of the vertical port 83, as apparent in FIGS. 6–12. The splines 101 are distributed about the inner circumference of the port 83 at regular intervals with each of the splines 101 extending to approximately three-quarters of the weight of the port. Each spline 101 has a terminal end 105 that is wedge-shaped and configured to permit a complimentary-shaped object such as one of the protuberances 99 to slide across the bottom edge of the terminal end 105 up into a space 107 bounded by adjacent parallel splines 101 and the interior wall 103 of the port 83.

The motion associated with a single cycle of actuation of the ratchet mechanism including the plunger 31 and the cylindrical sleeve 25 in cooperation with the splines 101 will now be described as is illustrated in FIGS. 6–12. The vertical splines 101 are separated by a portion of the interior wall 103 creating the space 107 which can accommodate a plunger protuberance 81 and a ratchet protuberance 99. Each of the protuberances 81 and 99 extend radially outward from the respective components to which they are attached and are slidably received in the space 107. Each of the splines 101 includes the terminal end 105 which is formed into a ratchet-shaped ramp at the lower extremity of the splines. As will hereinafter become apparent, it is essential that the location of the protuberances 81 relative to the teeth 79 is angularly offset when compared to the position of the protuberances 99 relative to the teeth 97. This feature is readily apparent in FIG. 5.

Due to the presence of the auxiliary spring 29 between the plunger 31 and the ratchet sleeve 25, their respective teeth 79 and 97 are normally held in a separated position as apparent in FIG. 6. When the plunger 31 is depressed, the plunger teeth 79 engage the ratchet teeth 97 (FIG. 7) and then force the ratchet sleeve 25 downwardly until it reaches the position illustrated in FIG. 8. Due to the offset of the positions of the respective teeth relative to the respective protuberances, when both the protuberances 81 and the protuberances 99 reside between the splines 101, the teeth 79 and the teeth 97 do not completely mesh as is apparent in FIG. 7.

Once the protuberance 99 has been pushed beyond the end on the spline 101 (FIG. 8), the ratchet sleeve 25, driven by the force of the mainspring 23, is free to rotate and close the gap between teeth 79 and 97 as is illustrated in FIG. 9. At this point, the plunger 31 is fully depressed as is the mainspring 23 located within the contact cup 27 between its first end 49 and the ledge 63 of the center post 57. Additionally, the auxiliary spring 29, which is located in the hollow 45 of the plunger 31, is also completely compressed.

The maximum potential energy that is available in the compressed springs is now stored in the mainspring 23 and in the auxiliary spring 29. The force of the auxiliary spring 29 counters only a minor portion of the force the mainspring 23 exerts upon the ratchet sleeve 25. In accordance with the invention, the force exerted by the auxiliary spring 29 is substantially lower than the force exerted by the mainspring 23 such that maximum compression of the auxiliary spring 29 is achieved before any compression of the mainspring 23 begins. Additionally, the length, spring rate and amount of preload of the mainspring is selected such that the minimum amount of force necessary to ensure proper contact between the terminals is ensured while the plunger is in its extended position and only the minimal amount of force necessary to drive the ratcheting mechanism is generated when fully depressed. A relatively long spring with a relatively low spring rate subjected to considerable preload provides a substantially constant force throughout the relatively short stroke of the plunger. The net force exerted on the ratchet mechanism during ratcheting is the difference between the force generated by the compressed mainspring and the force generated by the compressed auxiliary spring. Upon release, the push button plunger 31 begins to retract through the vertically extending port 83 driven by the energy stored in the mainspring 23. Concurrently, the plunger protuberances 81 correspondingly retract upwardly within the space 107.

As the plunger protuberances 81 recede within the space 107, the ratchet sleeve 25, driven by the force of the mainspring 23, attempts to follow. However, the camming profile of the terminal end 105 of the splines 101 force the protuberance 99 to rotate further into the adjacent space 107. As the ratchet protuberance 99 slides down the ramp-shaped terminal end 105 and up the adjacent space 107, the ratchet sleeve 25 is caused to rotate in the direction urged by the ramp-shaped terminal end 105. Instead of simply snapping into the position illustrated in FIGS. 9 and 10 the motion is dampened by the presence of the auxiliary spring 29 and it is the net force, i.e. the difference between the mainspring force and the countering auxiliary spring force that determines the dynamics of the ratchet sleeve 25. This causes the ratchet sleeve to accelerate at a lower rate and hence engage its seated positions at a lower velocity. As a result, the audible noise is significantly reduced.

Figure 15:
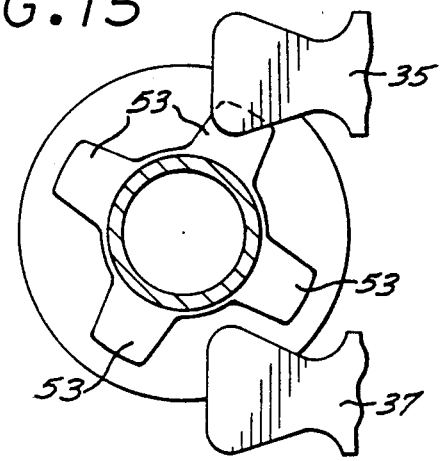
FIGS. 15 and 16 are top planar views of the contact cup in positions corresponding to the positions in FIGS. 13 and 14 respectively.
Figure 16:
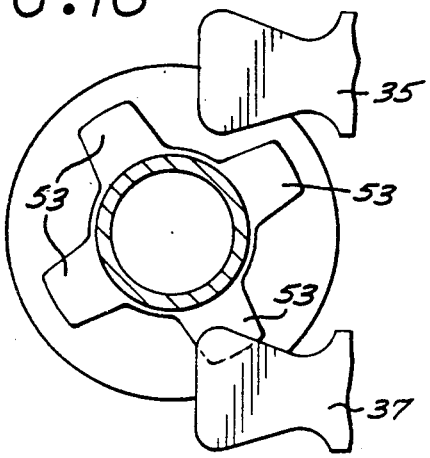

Because the vertical grooves 89 of the contact cup 27 receive the vertical ribs 87 of the ratchet sleeve 25, the contact cup 27 is carried with the rotating ratchet sleeve 25. As the contact cup 27 is rotated, the plurality of extension ears 53 rotate therewith. As the electrical conductors are circuited through the ratchet switch 21 via the common input conductor 59 and through either the first input electrical conductor 71 or the second input electrical conductor 72, the rotating contact cup 27 interconnects either the first terminal 35 or the second terminal 37 with the common input terminal 33 as is illustrated in FIGS. 15 and 16. Due to the force exerted by the mainspring 23, the first input terminal 35 or the second input terminal 37 maintains positive electrical contact with the extension ear 53 when in either closed circuit position.

After the ratchet protuberance 99 has travelled up the ramp-shaped terminal end 105 of the vertical spline 101, it enters the adjacent space 107 between the vertical splines and is driven upwardly by the energy stored in the mainspring 23.

Upon the completion of the switching cycle, the extension ears 53, which act as rotating contacts, have changed positions so that the electrical connections to the first input terminal 35 and the second input terminal 37 have been reversed as apparent when comparing FIGS. 15 and 16. Thus, the rotation of the ratchet sleeves 25 by 45 degrees results in a single pole, double-throw rotary switch action which does not require sliding contact between either of the input terminals 35, 37 or the rotating extension ears 53.

The auxiliary spring 29 dampens the dynamics of the ratchet mechanism during a ratcheting operation and provides a small restoring force to extend the plunger 31 after its release. The auxiliary spring is a compression-type helical spring which is mounted within the hollow 45 of the plunger 31. The design of the auxiliary spring 29 is such that the force it exerts when it is compressed as far as the interaction of the plunger teeth 79 and the ratchet sleeves teeth 97 permit, is insufficient to reduce the length of the mainspring 23 due the preload the mainspring is subject to in its compressed position within the contact cup 27. The preload is achieved by the interaction between either of the terminals 35, 37 and an extension ear 53 which limits the upward movement of the contact cup 27. If the auxiliary spring 29 exerted a greater force downward than described, electrical contact would be lost as soon as the plunger 31 is even slightly depressed. Similarly, if for whatever reason, the plunger's upward movement were interfered with, electrical contact would never be achieved.

The interaction of the mainspring 23 with the auxiliary spring 29 will now be described in more detail. Generally speaking, as a deflective force is applied to a spring, an equal and opposite force is exerted by that spring accompanied by a commensurate amount of deflection. A coil-spring, when compressed, will exert such an equal and opposite force. Generally, the relationship between force and the amount of compression is a linear one. The amount of compression can be correlated with the working length of a spring wherein its free length minus its compression is equal to its working length:

$$\text{working length} = \text{free length} - \text{compression} \quad (1)$$

Figure 17:
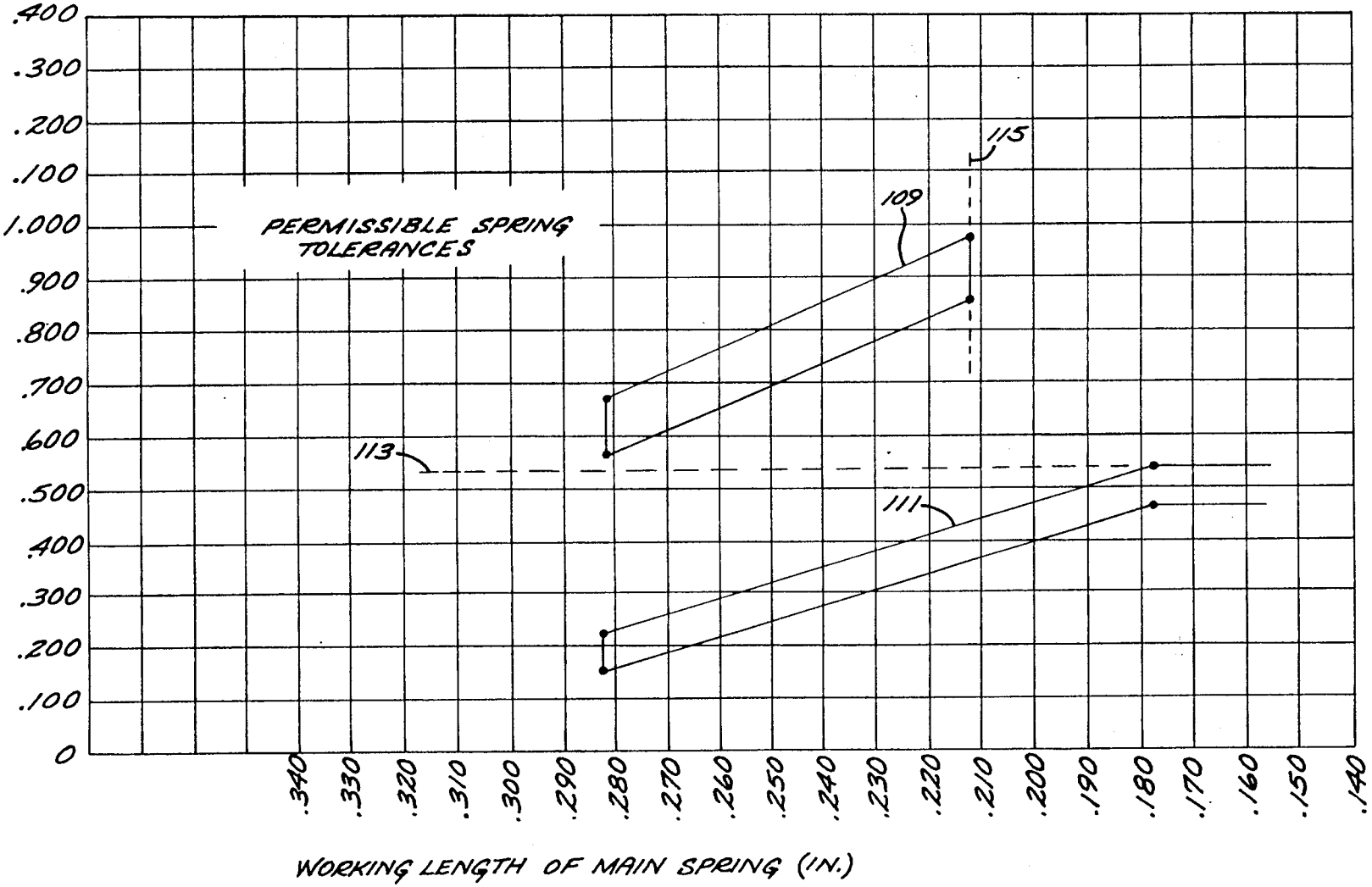
FIG. 17 is a graph illustrating the spring characteristics of the miniature ratchet switch of FIG. 1.

FIG. 17 graphically represents the interrelationship of force and working length for the springs as used in the device of the present invention. The vertical axis is calibrated in pounds of force while the horizontal axis is calibrated in inches of working length of the mainspring 23. A first area 109 of the graph illustrates the permissible force tolerances of the mainspring 23 as a function of its length while the second area 111 illustrates the permissible force tolerance of the auxiliary spring 29, again as a function of the length of the mainspring 23 The interrelationship between the working lengths of both springs is a function of the complex mechanical interaction of the ratchet teeth 97, plunger teeth 79, splines 101, spline terminal ends 105, ratchet sleeve protuberances 99 and plunger protuberances 81 throughout the depression, rotation and release processes described above.

The graphic display of FIG. 17 illustrates the fact that for a given working length of the mainspring 23, the force exerted by the auxiliary spring 29 is always less than the force exerted by the mainspring 23. This design requirement serves to ensure that the contact between extension ears 53 and 37 is preserved until the plunger 31 is depressed so far as to contact the ratchet sleeve ledge 95. A sufficient force differential with which the ratchet mechanism is driven into its seated position during the ratchet operation is also thereby achieved.

As can be ascertained form the graph, the maximum working length the mainspring 23 attains is 0.282 inches, its further extension being limited by the engagement of an extension ear 53 of the contact cup 27 with either terminal 33 or 37. Tolerance area 109 thereby suggests that the permissible force exerted by the mainspring compressed length should be between 0.57 and 0.68 pounds which corresponds to the force necessary to ensure electrical contact between the terminals. It is to be noted that at no time is the auxiliary spring 29 capable of countering this much preload force (reference numeral 113).

Upon depression of the plunger 31, the working length of the auxiliary spring 29 is compressed until the plunger teeth 79 engage the ratchet teeth 97. Further depression of the plunger then does not alter the force exerted by the auxiliary spring as is apparent by the flattening of tolerance area 111 at 113. At the point of ratchet, the net force exerted on the ratchet mechanism is the difference between the force generated by the compressed mainspring and the force countered by the compressed auxiliary spring. The lengths, rates, and loadings have to be selected such that this net force suffices to drive the ratcheting motion.

Both the mainspring 23 and the auxiliary spring 29 are small helically wound springs which normally have sharp edges at each end of the spring coil. The sharp edge of the auxiliary spring 29, in particular, rubbing against the top of the plastic ratchet sleeve 25 would cause premature failure due to a machining action. This machining action is caused by the ratchet sleeve 25 being rotated each time the plunger 31 is depressed. To counter this problem, the hard steel surface 47 is provided in the top of the ratched sleeve 25 to alleviate this potential source of premature failure. The hard steel surface 47 may be, for example, a rivet head or similar hard metal surface impervious to the sharp end of the spring. As the contact cup 27 rotates, the hard steel surface acts to prevent the sharp edge of the auxiliary spring coil from wearing through the top of the ratchet sleeve by friction, thus extending the service life of the ratchet switch 21.

An additional advantageous feature of the present invention includes attention to the winding direction of the auxiliary spring 29 to thereby reduce the probability of premature failure of the ratchet switch 21. An auxiliary spring wound in the same direction as the direction of rotation of the ratchet sleeve 25 offers less resisting torque to the rotation during activation of the ratchet mechanism. When a helical structure is under compression, the spring has a tendency to rotate apart in the direction of the helix. The helical spring has a tendency to cause the ratchet sleeve 25 to rotate and if the direction of the winding of the auxiliary spring 29 is chosen such that ratchet sleeve 25 is urged by the spring in the same direction as the direction of rotation induced by the ratcheting mechanism, wear of the ratchet mechanism is reduced. Proper attention to this parameter thereby serves to extend the service life of the entire switch 21.

Another novel feature of the instant invention is included to prevent the misalignment of the plunger teeth 79 and ratchet teeth 97. Due to the inherent tolerances associated with the auxiliary spring 29, the angular offset between the plunger teeth 79 and the ratchet teeth 97, and the possibly imprecise fit of the protuberances 81, 99 within the space 107, the possibility exists that the apex of the plunger protuberance 81 may engage the apex of the ratchet protuberance 99 and consequently jam the mechanism. In such an engagement, protuberance 99 will fail to slide across the cammed surface of the splined terminal end 105 when the plunger is depressed In order to effectively reduce the possibility of that occurrence, the present invention calls for the slight repositioning of the protuberance 81 relative to the plunger teeth 79. As is illustrated in detail FIG. 6, the position of the protuberance 81 is such that its apex 117 is slightly offset from the center line 119 of the protuberance. This offset minimizes the possibility of the apex 117 of protuberance 81 engaging in the apex 121 of protuberance 99 and insures that the protuberance 99 will slide across the terminal ends 105 completing the ratcheting operation.

During the operation of the single pole, double throw switch 21 of the preferred embodiment, the extension ears 53 of the contact cup 27 alternate making electrical contact between the first input terminal 35 and the second into terminal 37. Assuming that the path of electrical current flow enters the switch from either of the input terminals and exits the switch through the common input conductor 59, the electrical circuitry path is as follows The electrical energy enters the switch through either of the input terminals 35, 37. One of the input terminals 35, 37 makes contact with one of the extension ears 53 of the contact cup 27 when the switch is in the closed circuit position. Each of the extension ears 53 is connected to the contact cup 27 so that the flow of electrical energy through any one of the extension ears travels through the contact cup. The mainspring 23 is in electrical communication with the contact cup 27 and acts as a path for the electrical energy flow. The mainspring is mounted on the ledge 63 of the cone-head 61 making electrical contact with the ring portion of the common input terminal 33. Electrical energy flows through the mainspring and exits the switch via the common input terminal 33 and the common input conductor 59. Upon operating the ratchet mechanism as previously described, the contact cup 27 is carried with the ratchet sleeve 25 so that the extension ears 53 are rotated breaking contact with the first input terminal 35 and making contact with the second input terminal 37, or vice versa.

Each of the electrical conductors within the ratchet switch 21 are preferably comprised of beryllium copper, or in the alternative, phosphor bronze. Each of these metals will ensure good electrical conductivity along the conductors and terminals. The ratchet switch 21 is rated for both alternating current or direct current circuits with the voltage and amperage ratings depending upon the design specifications. Therefore, the ratchet switch 21 may be employed in many different switching applications. A further advantageous feature is that continuity of a closed circuit is maintained until the plunger undergoes a substantial amount of depression. Additionally, by employing the specific modification described above, many components employed in ratchet switches of the past may also be employed in the ratchet switch 21.

A single pole, single throw function can be achieved by eliminating the second terminal 37 and conductor 73. Therefore, if it is assumed that the electrical energy enters the ratchet switch via a first input electrical conductor 71 exists the ratchet switch through a common input conductor 59, the switch is reduced to an "on-off" device. As a push button plunger 31 is operated, a contact cup 27 is carried in rotation with a ratchet sleeve 25. Because the contact cup 27 rotates only forty-five degrees for each ratchet operation, two ratchet operations are required in order to rotate one of a plurality of extension ears 53 by ninety degrees. Therefore, contact between a common input terminal 33 and a first input terminal 71 can be achieved only on every other ratcheting operation. The dynamics of the ratcheting mechanism remain the same.

From the foregoing, it will be appreciated that the miniature push button ratchet switch of the present invention insures that electrical contact will be maintained until the plunger is depressed a substantial distance. The inclusion of the auxiliary spring additionally serves to reduce the amount of audible noise produced during the ratcheting operation. Further, the switch utilizes parts of known ratchet switches and is available in single pole, double-throw or single pole, single-throw configurations. Those skilled in the art will appreciate that, while a particular form of ratchet switch has been illustrated, the invention is adaptable to a variety of similar switch constructions that utilize mechanisms that are functionally similar. The switch employs heavy duty surfaces to minimize premature failure and includes a ratchet-plunger tooth offset to eliminate misoperation of the ratcheting mechanism.

While several particular forms of the invention have been illustrated and described, it will be apparent that various modifications can be made without departing from the spirit and scope of the invention. Accordingly, it is not intended that the invention be limited, except as by the appended claims.

What is claimed is:

1. A miniature switching apparatus for alternately interconnecting a plurality of electrical circuits, comprising:

a housing;

a plurality of first electrical contacts mounted within said housing each connectable to an electrical circuit;

a common second electrical contact mounted within said housing connectable to an electrical circuit;

interconnecting means rotatably mounted within said housing for alternately interconnecting said common second electrical contact with one of said plurality of first electrical contacts depending upon said interconnecting means' rotational orientation within said housing;

an actuation element slidably mounted within and projecting form said housing;

a rachet mechanism for converting depression of said actuation element beyond a preselected depth to an incremented rotation of said interconnecting means, the rachet mechanism having a metallic bearing surface which provides a seat for one end portion of an auxiliary biasing means;

a preloaded main biasing means capable of exerting a preselected first range of bias, the preload being the minimum bias within said first range, said main biasing means being mounted within said housing and oriented to bias said interconnecting means firmly against one of said plurality of electrical contacts to ensure electrical continuity while said actuation element is depressed less than said preselected depth of depression, said main biasing means additionally being oriented to bias said ratchet mechanism for driving the rotation of said interconnecting means upon depression of said actuation element beyond the preselected range of depression; and the auxiliary biasing means being mounted within said actuation element and having two end portions, one end portion oriented to bias said actuation element so as to extend said element from said housing, the other end portion oriented to bias said rachet mechanism via contact with said rachet mechanism seat so as to oppose bias exerted by said preloaded main biasing means, said auxiliary biasing means having a preselected second range of bias which is less than the main biasing means' preload, whereby said actuation element must be depressed to beyond said preselected depth of depression before electrical continuity is broken between said interconnecting means and one of said plurality of electrical contacts.

2. A miniature switching apparatus for alternately interconnecting a plurality of electrical circuits, comprising:

a housing;

a plurality of first electrical contacts mounted within said housing each connectable to an electrical circuit;

a common second electrical contact mounted within said housing connectable to an electrical circuit;

interconnecting means rotatably mounted within said housing for alternately interconnecting said common second electrical contact with one of said plurality of first electrical contacts depending upon said interconnecting means' rotational orientation within said housing;

an actuation element slidably mounted within and projecting form said housing;

a rachet mechanism for converting depression of said actuation element beyond a preselected depth to an incremented rotation of said interconnecting means, the rachet mechanism having a metallic bearing surface which provides a seat for one end portion of an auxiliary biasing means;

a preloaded main biasing means capable of exerting a preselected first range of bias, the preload being the minimum bias within said first range, said main biasing means being mounted within said housing and oriented to bias said interconnecting means firmly against one of said plurality of electrical contacts to ensure electrical continuity while said actuation element is depressed less than said preselected depth of depression, said main biasing means additionally being oriented to bias said ratchet mechanism for driving the rotation of said interconnecting means via said rachet mechanism upon depression of said actuation element beyond the preselected range of depression; and the auxiliary biasing means being mounted within said actuation element and having two end portions, one end portion oriented to bias said actuation element so as to extend said element from said housing the other end portion oriented to bias said rachet mechanism via contact with said rachet mechanism seat so as to oppose bias exerted by said preloaded main biasing means, said auxiliary biasing means having a preselected second range of bias wherein its maximum bias is less than the main biasing means' preload and the net bias resulting from the main biasing means' maximum bias opposed by the auxiliary biasing means' maximum bias being equivalent to the minimum bias necessary to drive the rotation of said interconnecting means, whereby said actuation element must be depressed to beyond said preselected depth of depression before electrical continuity is broken between said interconnecting means and one of said plurality of electrical contacts and audible noise generated during switching operation is significantly reduced.

3. A miniature switching apparatus for alternately interconnecting a plurality of electrical circuits, comprising:

a housing;

a plurality of first electrical contacts mounted within said housing each connectable to an electrical circuit;

a common second electrical contact mounted within said housing connectable to an electrical circuit;

interconnecting means rotatably mounted within said housing for alternately interconnecting said common second electrical contact with one of said plurality of first electrical contacts depending upon said interconnecting means' rotational orientation within said housing;

an actuation element slidably mounted within and projecting form said housing;

a rachet mechanism for converting depression of said actuation element beyond a preselected depth to an incremented rotation of said interconnecting means;

a preloaded main biasing means capable of exerting a preselected first range of bias, the preload being the minimum bias within said first range, said main biasing spring being mounted within said housing and oriented to as to bias said interconnecting means firmly against one of said plurality of electrical contacts to ensure electrical continuity while said actuation element is depressed less than said preselected depth of depression, said main biasing coil spring additionally being oriented so as to bias said operating means for driving the rotation of said interconnecting means upon depression of said actuation element beyond the preselected range of depression; and an auxiliary coil spring wound opposite to that of the main biasing coil spring, the auxiliary coil spring being mounted within said actuation element and oriented to bias said actuation element so as to extend said element from said housing, said auxiliary coil spring additionally being oriented to bias said operating means so as to oppose bias exerted by said preloaded main biasing coil spring, said auxiliary coil spring having a preselected second range of bias which is less than the main biasing coil spring's preload, whereby said actuation element must be depressed to beyond said preselected depth of depression before electrical continuity is broken between said interconnecting means and one of said plurality of electrical contacts.

4. A miniature switching apparatus for alternately interconnecting a plurality of electrical circuits, comprising:

a housing;

a plurality of first electrical contacts mounted within said housing each connectable to an electrical circuit;

a common second electrical contact mounted within said housing connectable to an electrical circuit;

interconnecting means rotatably mounted within said housing for alternately interconnecting said common second electrical contact with one of said plurality of first electrical contacts depending upon said interconnecting means' rotational orientation within said housing;

an actuation element slidably mounted within and projecting form said housing;

operating means for converting depression of said actuation element beyond a preselected depth to an incremented rotation of said interconnecting means;

a preloaded main biasing coil spring capable of exerting a preselected first range of bias, the preload being the minimum bias within said first range, said main biasing coil spring being mounted within said housing and oriented so as to bias said interconnecting means firmly against one of said plurality of electrical contacts to ensure electrical continuity while said actuation element is depressed less than said preselected depth of depression, said main biasing coil spring additionally being oriented so as to bias said operating means for driving the rotation of said interconnecting means via said operating means upon depression of said actuation element beyond the preselected range of depression; and an auxiliary biasing coil spring wound opposite to the main biasing coil spring, said auxiliary biasing coil spring being mounted within said actuation element and oriented to bias said actuation element so as to extend said element from said housing, said auxiliary biasing coil spring additionally being oriented to bias said operating means so as to oppose bias exerted by said preloaded main biasing coil spring, said auxiliary biasing coil spring having a preselected second range of bias wherein its maximum bias is less than the main biasing coil spring's preload and the net bias resulting from the main biasing coil spring's maximum bias opposed by the auxiliary biasing coil spring's maximum bias being equivalent to the minimum bias necessary to drive the rotation of said interconnecting means, whereby said actuation element must be depressed to beyond said preselected depth of depression before electrical continuity is broker between said interconnecting means and one of said plurality of electrical contacts and audible noise generated during switching operation is significantly reduced.

* * * * *